US005396146A

United States Patent [19]

Nakamura et al.

[11] Patent Number: 5,396,146

[45] Date of Patent: Mar. 7, 1995

[54] SHADOW MASK SHEET, METHOD OF PRODUCING SAME AND CATHODE RAY TUBE PROVIDED THEREWITH

[75] Inventors: Shuichi Nakamura; Masato Hasegawa, both of Yasugi; Hakaru Sasaki, Matsue, all of Japan

[73] Assignee: Hitachi Metals, Ltd., Tokyo, Japan

[21] Appl. No.: 53,004

[22] Filed: Apr. 27, 1993

[30] Foreign Application Priority Data

Apr. 27, 1992 [JP] Japan ..... 4-134229
Feb. 1, 1993 [JP] Japan ..... 5-036101

[51] Int. Cl.[6] ..... C22C 38/08
[52] U.S. Cl. ..... 313/402
[58] Field of Search ..... 313/402–408; 148/336, 621, 653; 420/94

[56] References Cited

U.S. PATENT DOCUMENTS 5,209,900 5/1993 Nakamura et al. ..... 420/94

FOREIGN PATENT DOCUMENTS 01104453 4/1984 European Pat. Off. .
0176344 4/1986 European Pat. Off. .
0515954A1 12/1992 European Pat. Off. .
61044126 3/1936 Japan .
61-39343 2/1986 Japan .
61-190023 8/1986 Japan .
64-25944 1/1989 Japan .
2-51973 2/1990 Japan .
29655 3/1990 Japan .

*Primary Examiner*—Stephen Brinich
*Attorney, Agent, or Firm*—Sughrue, Mion, Zinn, Macpeak & Seas

[57] ABSTRACT

The shadow mask sheet having excellent etchability and made of an Fe-Ni invar alloy consisting essentially of 30–40 weight % of Ni, the balance being substantially Fe and inevitable impurities, having a percentage of {100} texture of 85% or more in a rolled surface and a fibrous microstructure in a transverse cross section can be produced by hot-rolling the Fe-Ni invar alloy; conducting cold rolling at a rolling reduction ratio of 85% or more and annealing at 700° C. or higher in this order at least once; and then conducting cold rolling at a rolling reduction ratio not exceeding that in the previous cold rolling step and annealing at a temperature of 850° C. or lower in this order.

40 Claims, 6 Drawing Sheets

50 μm

50 μm

10 μm

10 μm

FIG.3 ( a )
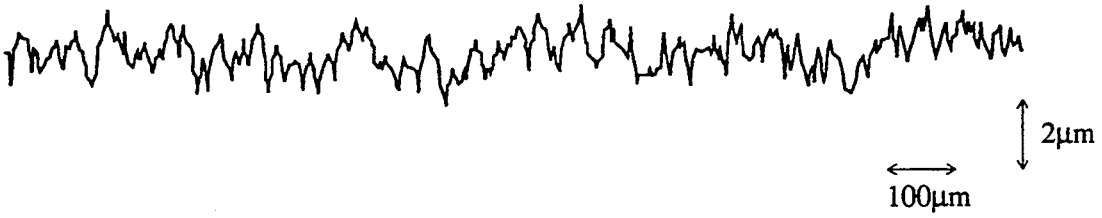
FIG.3 ( b )
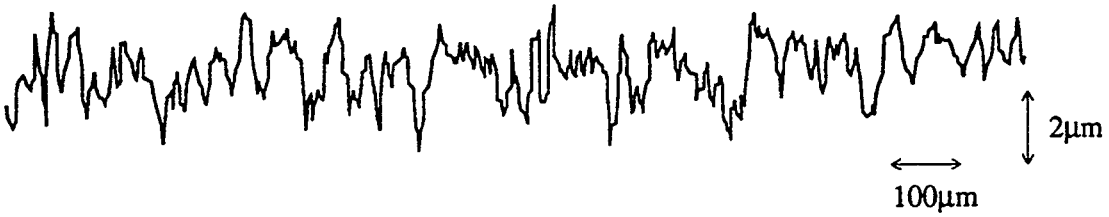

50 μm

50 μm

SHADOW MASK SHEET, METHOD OF PRODUCING SAME AND CATHODE RAY TUBE PROVIDED THEREWITH

BACKGROUND OF THE INVENTION

This invention relates to a shadow mask sheet made of an Fe-Ni invar alloy, and more particularly to a shadow mask sheet having excellent etchability, a final rolled sheet for a shadow mask sheet, a method of producing such a shadow mask sheet and a cathode ray tube using a shadow mask produced from such a sheet.

Recently, an Fe-Ni invar alloy has been finding wider application in place of aluminum-killed, low-carbon iron materials (AK materials) in cathode ray tubes of television sets and high-resolution displays. However, it is known that the Fe-Ni invar alloy has poorer etchability than the AK materials. Particularly, in recent ultrahigh-precision shadow masks, even slight etching unevenness such as roughness of etched surface and differences of pore shapes would lead to appearance deficiency of shadow masks. Further, a cathode ray tube provided with a shadow mask having such deficiency suffers from the scattering of electron beams, resulting in poor display image.

With respect to shadow mask sheets requiring high-precision etching, proposals have been made in Japanese Patent Publication No. 2-51973 and Japanese Patent Laid-Open No. 61-190023 to reduce impurity elements such as C, O, N, etc. which serve to prevent the etching of the shadow mask sheet, thereby reducing the unevenness of the shadow mask.

As shown in Japanese Patent Publication No. 2-51973 and Japanese Patent Laid-Open No. 61-190023, it is well known that the reduction of the amounts of impurity elements such as C, O, N, etc. which serve to prevent the etching of the shadow mask sheet is the least requirement for improving the etching speed or etching quality of high-resolution shadow mask sheets which should be worked extremely precisely. However, the improvement of evenness of an etched surface and the decrease of differences of pore shapes cannot be obtained only with the reduction of the amounts of impurity elements.

Japanese Patent Laid-Open No. 61-39343 and Japanese Patent Publication No. 2-9655 proposed to improve the alloy structure of a shadow mask sheet for achieving fine, uniform etched pores by controlling the size and orientation of crystal grains. However, in these methods, complicated control in cold rolling and annealing processes is necessary. Also, there are still problems in the roughness and pore shapes in the etched surface, failing to provide highly precisely etched shadow mask sheets. Now that the qualities of cathode ray tubes have been becoming increasingly higher, shadow mask sheets excellent in etchability are strongly demanded.

OBJECT AND SUMMARY OF THE INVENTION

Accordingly, an object of the present invention is to provide a shadow mask sheet having excellent etchability suitable for a high-precision to ultrahigh-precision shadow mask.

Another object of the present invention is to provide a final rolled sheet for such a shadow mask sheet.

A further object of the present invention is to provide a method of producing such a shadow mask sheet.

A still further object of the present invention is to provide a cathode ray tube provided with a shadow mask produced from such a sheet.

In view of the above objects, the inventors have conducted intense research on the relation between the structure of an Fe-Ni invar alloy and its etchability. The conventional shadow mask sheet has a recrystallization structure in which crystal grains are usually controlled to have sizes of about JIS No. 8-11. This is because if crystal grains are too large, large unevenness (raggedness and irregularity) is generated on etched surfaces of pores, due to the difference in etching speed among the crystal grains. Accordingly, the smoothness of the etched surface is presently achieved by making the crystal grains as fine as possible.

The inventors have conducted experiment on cold rolling and annealing conditions to reduce the roughness of the etched surface, and have found that complicated control of alloy structure is needed in the rolling process in the above methods disclosed by Japanese Patent Laid-Open No. 61-39343 and Japanese Patent Publication No. 2-9655. Also, due to the composition of the Fe-Ni invar alloy used in Japanese Patent Laid-Open No. 61-39343 and Japanese. Patent Publication No. 2-9655, sufficiently reduced roughness cannot be achieved on the etched surface even though the crystal grains are controlled to have small sizes of about JIS No. 11.

Noting the prospect that if the shadow mask sheet is treated to have a rolled alloy structure having no clear grain boundaries, the influence of the crystal grains might be removed, the inventors have conducted intense research. As a result, it has been found that extremely good etchability can be achieved by providing the rolled sheet for a shadow mask sheet with a fibrous microstructure in a transverse cross section of the sheet.

Further, it has been found that the etchability of the shadow mask sheet can be greatly improved by increasing the percentage of {100} texture in the alloy structure.

In addition, it has been found that by adding particular elements (at least one of Nb, Ti, Zr, Mo, V, W, Be, Si, Al and Ta, at least one of B, Mg and Ca, Co and/or Cr) to the Fe-Ni invar alloy for the shadow mask sheet the fibrous microstructure can be improved, thereby achieving further thinning of the sheet to improve the etchability. Also, it has been found that by reducing the amounts of impurity elements such as C, S, P, O and N the fibrous microstructure can be further improved.

The present invention has been completed based on these findings.

Thus, the shadow mask sheet having excellent etchability according to the first embodiment of the present invention is made of an Fe-Ni invar alloy consisting essentially of 30–40 weight % of Ni, the balance being substantially Fe and inevitable impurities, the sheet having a percentage of {100} texture of 85% or more in a rolled surface, and having a fibrous microstructure in a transverse cross section of the sheet. In this Fe-Ni invar alloy, the inevitable impurities such as C and Mn may be included in such amounts that C is 0.05 weight % or less and Mn is 0.1 weight % or less, although the amounts of the inevitable impurities are preferably as small as possible.

The shadow mask sheet having excellent etchability according to the second embodiment of the present invention is made of an Fe-Ni invar alloy consisting essentially of 30–40 weight of Ni, 0.001–3 weight % in totality of at least one element selected from the group consisting of Nb, Ti, Zr, Mo, V, W, Be, Si, Al and Ta, the balance being substantially Fe and inevitable impurities, the sheet having a percentage of {100} texture of 85% or more in a rolled surface, and having a fibrous microstructure in a transverse cross section of the sheet.

The shadow mask sheet having excellent etchability according to the third embodiment of the present invention is made of an Fe-Ni invar alloy consisting essentially of 30–40 weight % of Ni, the balance being substantially Fe and inevitable impurities, a part of Ni being substituted with 10 weight % or less of Co and/or 5 weight % or less of Cr, the sheet having a percentage of {100} texture of 85% or more in a rolled surface, and having a fibrous microstructure in a transverse cross section of the sheet.

The shadow mask sheet having excellent etchability according to the fourth embodiment of the present invention is made of an Fe-Ni invar alloy consisting essentially of 30–40 weight of Ni and 0.0001–0.001 weight % in totality of at least one element selected from the group consisting of B, Mg and Ca, the balance being substantially Fe and inevitable impurities, the sheet having a percentage of {100} texture of 85% or more in a rolled surface, and having a fibrous microstructure in a transverse cross section of the sheet.

In each of the above shadow mask sheets, the amounts of the inevitable impurities are preferably restricted such that C is 0.005 weight % or less, S is 0.005 weight % or less, P is 0.005 weight or less, 0 is 0.005 weight % or less, and N is 0.005 weight % or less.

In each of the above shadow mask sheets, an area ratio of a non-fibrous microstructure in a transverse cross section of the sheet is less than 50% or preferably substantially zero.

In each of the above shadow mask sheets, a surface of the sheet spray-etched with an $FeCl_3$ solution (42 Baumé, 60° C.) has a surface roughness Ra of 0.6 μm or less in the transverse direction of the sheet.

In each of the above shadow mask sheets, the crystal grains have an average aspect ratio of 3 or more in a transverse cross section of the sheet, and the sheet has a Vickers hardness HV of 130 or more.

The final rolled sheet (before annealing) for a shadow mask sheet having excellent etchability according to the fifth embodiment of the present invention is made of the abovedescribed Fe-Ni invar alloy, the percentage of {100} texture being changed by 30% or less by annealing at 850° C. or lower.

The method of producing a shadow mask sheet having excellent etchability according to the sixth embodiment of the present invention comprises the steps of hot-rolling the abovedescribed Fe-Ni invar alloy; conducting cold rolling at a rolling reduction ratio of 85% or more and annealing at 700° C. or higher in this order at least once; and then conducting cold rolling at a rolling reduction ratio not exceeding that in the previous cold rolling step and annealing at a temperature of 850° C. or lower in this order.

The cathode ray tube according to the seventh embodiment of the present invention is provided with a shadow mask prepared from the above-described shadow mask sheet by etching.

BRIEF DESCRIPTION OF THE DRAWINGS

FIG. 1(*b*) is a photomicrograph showing the alloy structure of the shadow mask sheet of Sample F1 in a transverse cross section of the sheet;

FIG. 2(*b*) is a scanning-type electron photomicrograph showing the alloy structure of the shadow mask sheet of Sample F1 on an etched surface of the sheet;

FIG. 3(*a*) is a graph showing the surface roughness of the shadow mask sheet of the present invention (Sample A1) on an etched surface of the sheet;

FIG. 3(*b*) is a graph showing the surface roughness of the shadow mask sheet of Sample F1 on an etched surface of the sheet;

FIG. 4(*b*) is a photomicrograph showing the alloy structure of the shadow mask sheet of Sample A4 (annealed at 830° C. at the final annealing step) in a transverse cross section of the sheet;

DETAILED DESCRIPTION OF THE INVENTION

Figure 1:
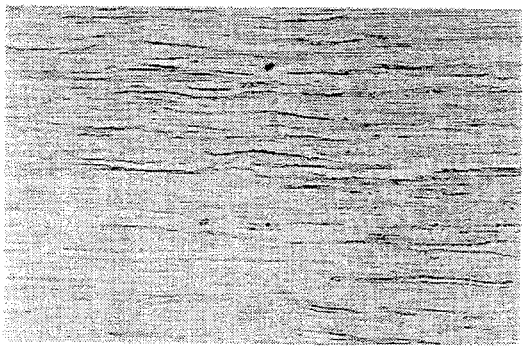
FIG. 1(*a*) is a photomicrograph showing the alloy structure of the shadow mask sheet of the present invention (Sample A1) in a transverse cross section of the sheet.
Figure 1:
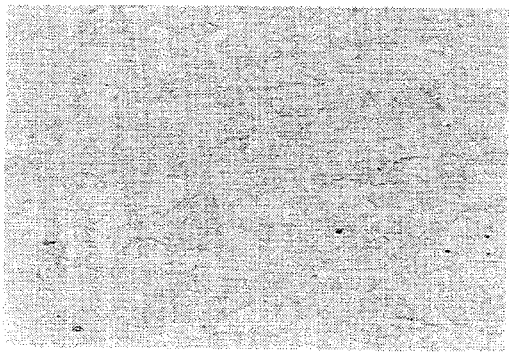

[A] Composition of Shadow Mask Material (1) Ni: 30–40 Weight %

When the amount of Ni is less than 30 weight %, the austenite structure is unstable. On the other hand, when it exceeds 40 weight %, the shadow mask sheet shows an increased thermal expansion coefficient, failing to satisfy the primary requirement of a low thermal expansion coefficient. Accordingly, the amount of Ni should be 30–40 weight %.

(2) Reinforcing Elements :0.001–3 Weight %

One or more elements selected from the group consisting of Nb, Ti, Zr, Mo, V, W, Be, Si, Al and Ta may be optionally added to the shadow mask sheet as reinforcing elements. When the total amount of the reinforcing elements is less than 0.001 weight sufficient reinforcing effects cannot be achieved. On the other hand, when it exceeds 3 weight %, carbides and intermetallic compounds are easily generated, which appear on the inner surfaces of etched pores, making their shapes ragged or irregular. Also, too much reinforcing elements accelerate surface oxidation of the shadow mask sheet, and the resulting oxide layer cannot easily be removed by a treatment before the etching. The oxide layer drastically decreases the adhesion of a resist to the shadow mask sheet. Therefore, the total amount of the reinforcing elements, if any, should be 0.001–3 weight %. More preferably, it is 0.1–1.5 weight %.

(3) Impurity Elements

Impurity elements such as C, S, P, O and N serve to drastically deteriorate the etchability of the shadow mask sheet and the evenness of the etched shadow mask sheet even in trace amounts. By reducing their amounts the above properties can be extremely improved. Specifically, by restricting their amounts to:

C: ≦0.005 weight %, preferably≦0.003 weight %,
S: ≦0.005 weight %, preferably≦0.003 weight %,
P: ≦0.005 weight %, preferably≦0.003 weight %,
O: ≦0.005 weight %, preferably≦0.003 weight %, and
N: ≦0.005 weight %, preferably≦0.003 weight %, an ultrahigh-precision shadow mask can be obtained.

(4) Hot Working-improving Elements: 0.0001–0.001 Weight %

B, Mg and Ca are hot working-improving elements. Since the Fe-Ni invar alloys are poor in hot workability, it is preferable to add small amounts of the hot working-improving elements to the Fe-Ni invar alloys. When the total amount of the hot working-improving elements is less than 0.0001 weight %, sufficient hot working-improving effects cannot be achieved. On the other hand, when it exceeds 0.001 weight %, too much precipitation of the hot working-improving elements takes place in crystal grain boundaries, thereby reinforcing the crystal grain boundaries and increasing a resistance to etching. Therefore, the total amount of the hot working:improving elements, if any, is preferably 0.001 weight % or less to maintain the good etchability.

(5) Co and/or Cr

When a part of Ni is substituted with an equal amount of Co, the thermal expansion coefficient of the shadow mask sheet can be further reduced. However, if the amount of Co exceeds 10 weight %, the shadow mask sheet would become undesirably expensive. Accordingly, the amount of Co, if any, is preferably restricted to 10 weight % or less. More preferably, Co is 5 weight % or less.

Cr, which is an element effective for decreasing the proof stress of the shadow mask sheet, may also be partially substituted for an equal amount of Ni. However, when Cr is added in an amount exceeding 5 weight %, the shadow mask sheet shows an increased oxidation resistance, whereby the growth of an oxide layer is suppressed in a blackening treatment. Accordingly, the amount of Cr, if any, is preferably restricted to 5 weight % or less. More preferably, Cr is 3 weight % or less.

[B] Pre-rolled Sheet

In general, a cubic crystal structure (each (100) surface is in parallel with a rolled surface, rolling direction, and thickness direction) is formed in the Fe-Ni invar alloy in the process of recrystallization. However, when the cold rolling reduction ratio is less than 85% or a subsequent annealing is conducted at a temperature lower than 700° C., a sufficient cubic crystal structure cannot be obtained. Therefore, in the production of the pre-rolled sheet, it is very important to form a sufficient cubic crystal structure by recrystallization by cold rolling at a rolling reduction ratio of 85% or more and annealing at 700° C. or higher in this order at least once, in order that the resulting shadow mask sheet can have an optimum fibrous microstructure.

[C] Final Rolled Sheet

This pre-rolled sheet having a sufficient cubic crystal structure is subsequently cold-rolled to produce a final rolled sheet having a fibrous structure.

[D] Shadow Mask Sheet (1) Alloy Structure (a) Percentage of {100} Texture

In the alloy structure of the shadow mask sheet of the present invention, it is indispensable that the percentage of {100} texture of crystal grains is 85% or more. When the percentage of {100} texture is less than 85%, unevenness is generated on an etched surface between crystal grains due to the difference of crystal grains' orientations. Such unevenness of the etched surface leads to the unevenness of the resulting shadow mask. More preferably, the percentage of {100} texture is 90% or more.

(*b*) Fibrous Microstructure

The shadow mask sheet of the present invention has a substantially fibrous microstructure in a transverse cross section which is vertical in the transverse direction of the sheet, which is formed by rolling under particular conditions.

The percentage of a non-fibrous microstructure (non-fibrous crystal grains) is determined by the following formula:

$$\text{Percentage of a non-fibrous microstructure} = (\text{Area of non-fibrous microstructure}/\text{Unit area}) \times 100\%.$$

Figure 4:
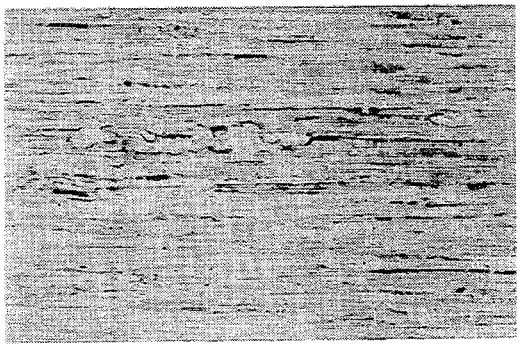
FIG. 4(*a*) is a photomicrograph showing the alloy structure of the shadow mask sheet of the present invention (Sample A4) in a transverse cross section of the sheet.
Figure 4:
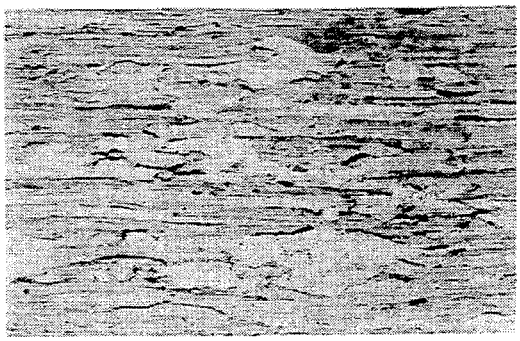

Incidentally, the non-fibrous microstructure means a microstructure (crystal grains) formed in the shape of island among the fibrous microstructure in a transverse cross section of the shadow mask sheet as shown in FIGS. 4 (*a*) and (*b*). The non-fibrous microstructure (crystal grains) is different from a polygonal recrystallization structure usually observed in an austenite iron. This non-fibrous microstructure presumably corresponds to a microstructure in an initial stage of recrystallization.

When the percentage of the non-fibrous microstructure (non-fibrous crystal grains) exceeds 50% in a transverse cross section of the shadow mask sheet, there is a substantial difference in an etching speed between the non-fibrous microstructure and the fibrous microstructure, failing to achieve a highly even etched surface which is an indispensable requirement of the present invention. Accordingly, the percentage of a non-fibrous microstructure is preferably less than 50%. More preferably, it is 30% or less.

(c) Average Aspect Ratio

The average aspect ratio of crystal grains is determined by calculating a ratio of a maximum size in a rolling direction to a maximum size in a direction perpendicular to the rolling direction on each crystal grain, and averaging the resulting ratios. In practice, a straight line is drawn in a thickness direction of the sheet on a photomicrograph taken in the above transverse cross section at a proper magnification, 10 largest crystal grains (both ends should be within the photomicrograph) crossing the straight line are selected by a naked eye observation, and the above ratios are calculated and averaged.

When the average aspect ratio of crystal grains is less than 3, good etchability cannot be obtained. Accordingly, the average aspect ratio of crystal grains is preferably 3 or more. More preferably, it is 10 or more.

(2) Properties (a) Surface Roughness

When the roughness Ra of an etched surface exceeds 0.6 μm in a transverse direction, electron beams are easily scattered at etched pores, resulting in poor display image. Therefore, the roughness Ra of an etched surface is preferably 0.6 μm or less. The shadow mask sheet of the present invention sufficiently satisfies this requirement.

(b) Hardness

When the shadow mask sheet has a Vickers hardness HV of less than 130, it is likely to be bent or curved in the process of etching, etc. Accordingly, the Vickers hardness HV of the shadow mask sheet is preferably 130 or more.

[E] Method of Production (1) Production of Final Rolled Sheet

As described above, it is very important to form a sufficient cubic crystal structure by recrystallization at least once in the pre-rolled sheet, in order to obtain the shadow mask sheet having an optimum fibrous microstructure. For this purpose, cold rolling at a rolling reduction ratio of 85% or more and annealing at 700° C. or higher are conducted in this order at least once to provide the pre-rolled sheet in which a cubic crystal structure is sufficiently developed. The pre-rolled sheet having a sufficient cubic crystal structure is then cold-rolled to produce a final rolled sheet.

The final rolled sheet little suffers from the change of percentage of {100} texture by the subsequent annealing step.

(2) Production of Shadow Mask Sheet

The shadow mask sheet of the present invention can maintain a fibrous microstructure and a high percentage of {100} texture after the annealing, as long as the cold rolling is conducted at a rolling reduction ratio not exceeding that in the pre-rolling step and the annealing is conducted at a temperature of 850° C. or lower. This is an important feature of the method of the present invention in order to avoid the cubic structure formed in the pre-rolling step from being destroyed.

Incidentally, after the annealing at a temperature of 850° C. or lower, which is the final step in the method of the present invention, cold rolling at a rolling reduction ratio of about 20% or less may be conducted, if necessary, to provide the sheet with a dull surface and to trim the shape of the sheet, and further annealing at a temperature of 850° C. or lower may be conducted to remove strain from the sheet. Since the alloy structure of the sheet is not changed by these treatments, high etchability can be maintained.

As described above, a hot-rolled sheet having a composition of the present invention is cold-rolled and annealed under such conditions as to form a sufficient cubic structure in the pre-rolling step, and the pre-rolled sheet is then cold-rolled under such conditions as to produce a final rolled sheet having a fibrous microstructure and then annealed to provide a finish sheet (shadow mask sheet) having an etched surface having extremely decreased unevenness and so showing excellent etchability.

[F] Cathode Ray Tube

The cathode ray tube of the present invention is provided with a shadow mask worked from the above shadow mask sheet. Since the shadow mask sheet is excellent in etchability, it is provided with a smooth, even surface and highly accurate etched pores. The pores formed by etching are substantially free from raggedness and irregularity in shapes of their inner surfaces. Therefore, electron beams can uniformly pass through the pores of the shadow mask, thereby realizing the high reproducibility of three primary colors and high saturation without unevenness.

The present invention will be explained in further detail by way of the following Examples.

Examples and Comparative Examples

As shown in Table 1 below, various Fe-Ni invar alloys A, B1–B16, C1–C7, D1–D5 and E1–E5 were vacuum-melted by induction heating, cast and forged and hot-rolled at 1100–1150° C. to provide hot-rolled sheets having predetermined thicknesses.

TABLE 1

| | | | | | Impuritiers | | | | | | | | |
|---|---|---|---|---|---|---|---|---|---|---|---|---|---|
| No | Ni | Cr | Co | Reinforcing Element | B | Mg | Ca | C | S | P | O | N | Fe |
| A | 35.94 | — | — | — | — | — | — | 0.0015 | 0.0010 | 0.0009 | 0.0010 | 0.0010 | bal. |
| B1 | 35.93 | — | — | 0.98 Nb | 0.0002 | — | — | 0.0034 | 0.0014 | 0.0022 | 0.0018 | 0.0012 | bal. |
| B2 | 35.95 | — | — | 1.02 Ti | — | 0.0003 | — | 0.0022 | 0.0011 | 0.0020 | 0.0019 | 0.0015 | bal. |
| B3 | 35.88 | — | — | 0.49 Zr | — | — | 0.0005 | 0.0019 | 0.0008 | 0.0019 | 0.0021 | 0.0007 | bal. |
| B4 | 36.05 | — | — | 0.97 Mo | 0.0002 | 0.0002 | — | 0.0021 | 0.0007 | 0.0018 | 0.0011 | 0.0008 | bal. |
| B5 | 36.10 | — | — | 0.98 V | — | 0.0002 | 0.0002 | 0.0015 | 0.0009 | 0.0020 | 0.0015 | 0.0009 | bal. |
| B6 | 36.11 | — | — | 1.03 W | 0.0002 | — | 0.0002 | 0.0023 | 0.0016 | 0.0021 | 0.0016 | 0.0011 | bal. |
| B7 | 36.07 | — | — | 0.47 Be | 0.0002 | 0.0003 | 0.0002 | 0.0010 | 0.0018 | 0.0024 | 0.0016 | 0.0014 | bal. |
| B8 | 36.09 | — | — | 1.05 Si | — | — | — | 0.0011 | 0.0020 | 0.0023 | 0.0009 | 0.0007 | bal. |
| B9 | 35.88 | — | — | 1.03 AI | — | — | — | 0.0015 | 0.0009 | 0.0027 | 0.0011 | 0.0006 | bal. |
| B10 | 36.05 | — | — | 0.97 Ta | — | — | — | 0.0021 | 0.0014 | 0.0026 | 0.0012 | 0.0022 | bal. |
| B11 | 36.11 | — | — | 0.51 Nb, 0.44 Ti | 0.0005 | — | — | 0.0033 | 0.0015 | 0.0018 | 0.0015 | 0.0023 | bal. |
| B12 | 36.13 | — | — | 0.55 Nb, 0.61 Al | — | 0.0003 | — | 0.0019 | 0.0015 | 0.0017 | 0.0017 | 0.0020 | bal. |
| B13 | 36.08 | — | — | 0.20 Zr, 0.29 Be | — | — | 0.0005 | 0.0016 | 0.0008 | 0,0021 | 0,0009 | 0.0009 | bal. |
| B14 | 36.07 | — | — | 0.49 Si, 0.41 Ti | — | — | — | 0.0021 | 0.0014 | 0.0019 | 0.0018 | 0.0011 | bal. |
| B15 | 36.01 | — | — | 0.52 Mo, 0.43 V | — | — | — | 0.0022 | 0.0017 | 0.0020 | 0.0021 | 0.0012 | bal. |
| B16 | 35.96 | — | — | 0.55 Mo, 0.53 W | — | — | — | 0.0024 | 0.0009 | 0.0019 | 0.0019 | 0.0019 | bal. |
| C1 | 35.09 | — | 1.23 | — | 0.0002 | 0.0001 | 0.0001 | 0.0013 | 0.0007 | 0.0023 | 0.0021 | 0.0015 | bal. |
| C2 | 33.51 | — | 2.33 | — | — | — | — | 0.0011 | 0.0010 | 0.0027 | 0.0017 | 0.0015 | bal. |
| C3 | 31.09 | — | 4.89 | — | — | — | — | 0.0011 | 0.0009 | 0.0024 | 0.0009 | 0.0017 | bal. |
| C4 | 36.08 | 1.29 | — | — | 0.0004 | 0.0002 | 0.0001 | 0.0019 | 0.0011 | 0.0022 | 0.0008 | 0.0024 | bal. |
| C5 | 36.12 | 2.01 | — | — | — | — | — | 0.0024 | 0.0014 | 0.0021 | 0.0009 | 0.0023 | bal. |
| C6 | 36.15 | 4.13 | — | — | — | — | — | 0.0020 | 0.0015 | 0.0019 | 0.0014 | 0.0021 | bal. |
| C7 | 31.02 | 1.12 | 4.89 | — | 0.0002 | 0.0001 | 0.0001 | 0.0012 | 0.0006 | 0.0022 | 0.0008 | 0.0010 | bal. |
| D1 | 36.01 | — | — | — | 0.0001 | 0.0001 | 0.0001 | 0.0067 | 0.0010 | 0.0023 | 0.0019 | 0.0012 | bal. |
| D2 | 36.03 | — | — | — | — | — | — | 0.0023 | 0.0074 | 0.0027 | 0.0009 | 0.0017 | bal. |
| D3 | 35.95 | — | — | — | — | — | — | 0.0031 | 0.0009 | 0.0078 | 0.0011 | 0.0018 | bal. |
| D4 | 36.12 | — | — | — | — | — | — | 0.0021 | 0.0008 | 0.0019 | 0.0087 | 0.0009 | bal. |
| D5 | 35.87 | — | — | — | — | — | — | 0.0018 | 0.0013 | 0.0021 | 0.0011 | 0.0091 | bal. |
| E1 | 36.04 | — | — | 0.97 Nb | 0.0001 | 0.0001 | 0.0001 | 0.0077 | 0.0008 | 0.0019 | 0.0017 | 0.0015 | bal. |
| E2 | 36.11 | — | — | 0.91 Nb | — | — | — | 0.0012 | 0.0084 | 0.0022 | 0.0018 | 0.0007 | bal. |

TABLE 1-continued

| No | Ni | Cr | Co | Reinforcing Element | Impuritiers B | Mg | Ca | C | S | P | O | N | Fe |
|---|---|---|---|---|---|---|---|---|---|---|---|---|---|
| E3 | 36.00 | — | — | 0.89 Nb | — | — | — | 0.0021 | 0.0011 | 0.0091 | 0.0022 | 0.0006 | bal. |
| E4 | 35.97 | — | — | 0.98 Nb | — | — | — | 0.0018 | 0.0019 | 0.0021 | 0.0078 | 0.0009 | bal. |
| E5 | 35.96 | — | — | 1.02 Nb | — | — | — | 0.0015 | 0.0021 | 0.0018 | 0.0023 | 0.0093 | bal. |

A surface of each hot-rolled sheet was washed with an aqueous acid solution and polished. Thereafter, cold rolling and annealing as shown in Tables 2–4 were conducted on each hot-rolled sheet to produce a pre-rolled sheet. In Table 4, each sheet of F1–F6 was made of the same material as that of A.

Subsequently, the pre-rolled sheet was subjected to cold rolling at a rolling reduction ratio shown in the column of "Final Rolled Sheet" in Tables 2–4 to produce a final rolled sheet having a thickness of 0.15 mm and then to annealing at a temperature shown in the column of "Finished Sheet" in Tables 2–4. The finally rolled and annealed sheet having a thickness of 0.15 mm was degreased with a hot alkali solution, masked with a photoresist having a predetermined pattern and then spray-etched with an $FeCl_3$ solution (42 Baumé, 60° C.) to produce a shadow mask.

After each treatment, the percentage of {100} texture was calculated from relative intensities I of X-ray diffraction in major orientations of crystal grains {111}, {100}, {110} and {311} by the following formula:

$$D_{(100)}\% = I_{(100)} \times 100 / [I_{(111)} + I_{(100)} + I_{(110)} + I_{(311)}].$$

The percentage of {100} texture and the change of percentage of {100} texture by the finish annealing are shown in Tables 2–4.

Figure 2:
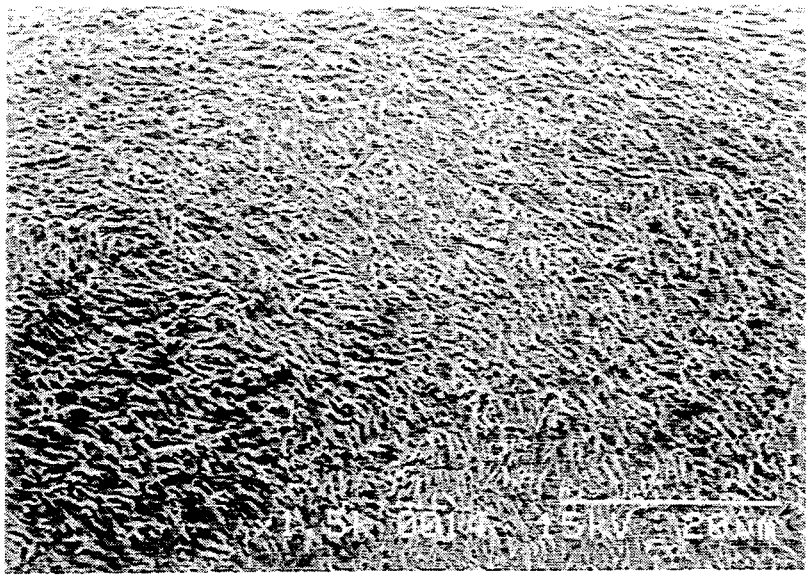
FIG. 2(*a*) is a scanning-type electron photomicrograph showing the alloy structure of the shadow mask sheet of the present invention (Sample A1) on an etched surface of the sheet.
Figure 2:
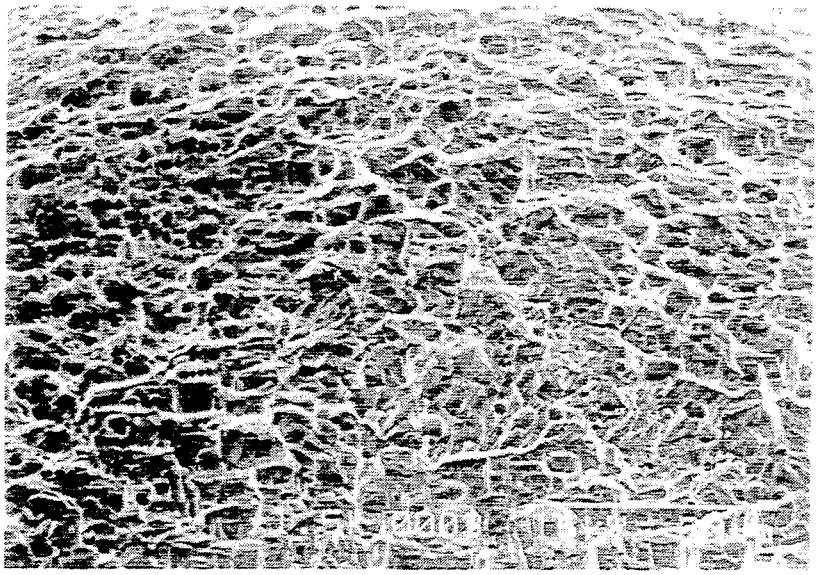

With respect to Sample No. A1 (the present invention) and Sample No. F1 (Comparative Example), the microstructure in a transverse cross section thereof was observed by a microscope at a magnification of 400 after etching the cross section with an aqua regia saturated with copper chloride $CuCl_2$ for 10 seconds, and the microstructure on an etched surface was observed by a scanning-type electron microscope (SEM) at a magnification of 1500. The microstructures in a cross section are shown in FIGS. 1(*a*) and 1(*b*), and the microstructures on an etched surface are shown in FIGS. 2(*a*) and 2(*b*). Further, the surface roughness Ra on an etched surface was measured with respect to Sample Nos. A1 and F1. The results are shown in FIGS. 3(*a*) and 3(*b*).

As shown in FIG. 1(*a*), the shadow mask sheet of the present invention (Sample No. A1) had a completely fibrous microstructure (non-fibrous microstructure: 0%) in a transverse cross section of the sheet and did not have clear crystal grain boundaries. On the other hand, the shadow mask sheet of Comparative Example (Sample No. F1) had a completely non-fibrous microstructure (non-fibrous microstructure: 100%) as shown in FIG. 1(*b*). Since the influence of crystal grain boundaries is very small in the shadow mask sheet of the present invention, the etched surface shows drastically decreased roughness as is clear from the comparisons of FIGS. 2(*a*) and 2(*b*) and FIGS. 3(*a*) and 3(*b*).

With respect to each finish sheet, hardness, an area ratio of a non-fibrous microstructure in a transverse cross section of the sheet, an aspect ratio, roughness (Ra) of etched surface and mask quality (unevenness after etching) were measured. The roughness (Ra) was measured on the spray-etched surface in the transverse direction. However, the surface roughness (Ra) in the transverse direction little differed from that in the rolling direction. The mask quality (unevenness) was evaluated by naked eye on the shadow mask. The results of the above measurements are shown in Tables 2–4.

TABLE 2

| No. | Pre-Rolled Sheet: Cold Rolling (%) | Pre-Rolled Sheet: Annealing Temp. (°C.) | Final Rolled Sheet: Cold Rolling (%) | Final Rolled Sheet: {100} Texture (%) | Finished Sheet: Annealing Temp. (°C.) | Finished Sheet: {100} Texture (%) | Finished Sheet: Change of {100} Texture |
|---|---|---|---|---|---|---|---|
| A1 | 95 | 950 | 80 | 98 | 730 | 99 | 1 |
| A2 | 95 | 950 | 80 | 97 | 800 | 98 | 1 |
| A3 | 95 | 950 | 90 | 80 | 730 | 89 | 9 |
| A4 | 90 | 950 | 80 | 81 | 730 | 92 | 11 |
| A5 | 95 | 800 | 80 | 76 | 730 | 88 | 12 |
| B1 | 95 | 950 | 80 | 97 | 730 | 98 | 1 |
| B2 | 95 | 950 | 80 | 98 | 730 | 99 | 1 |
| B3 | 95 | 950 | 80 | 98 | 730 | 100 | 2 |
| B4 | 95 | 950 | 80 | 98 | 730 | 99 | 1 |
| B5 | 95 | 950 | 80 | 97 | 730 | 98 | 1 |
| B6 | 95 | 950 | 80 | 97 | 730 | 98 | 1 |
| B7 | 95 | 950 | 80 | 96 | 730 | 99 | 3 |
| B8 | 95 | 950 | 80 | 97 | 730 | 98 | 1 |
| B9 | 95 | 950 | 80 | 97 | 730 | 99 | 2 |
| B10 | 95 | 950 | 80 | 96 | 730 | 97 | 1 |

| No. | Evaluation of Shadow Mask: Hardness (HV) | Non-Fibrous or Recrystallization Structure (%)* | Average Aspect Ratio | Ra of Etched Surface (μm)** | Mask Quality | Note |
|---|---|---|---|---|---|---|
| A1 | 180 | 0 | ≧30 | 0.35 | No Unevenness | Present Invention |
| A2 | 167 | 13 | ≧30 | 0.37 | No Unevenness | Present Invention |
| A3 | 178 | 5 | ≧30 | 0.33 | No Unevenness | Present Invention |
| A4 | 181 | 7 | ≧30 | 0.33 | No Unevenness | Present Invention |
| A5 | 174 | 8 | ≧30 | 0.32 | No Unevenness | Present Invention |
| B1 | 230 | 0 | ≧30 | 0.33 | No Unevenness | Present Invention |
| B2 | 234 | 0 | ≧30 | 0.33 | No Unevenness | Present Invention |

TABLE 2-continued

| | | | | | | |
|---|---|---|---|---|---|---|
| B3 | 221 | 0 | ≧30 | 0.35 | No Unevenness | Present Invention |
| B4 | 218 | 0 | ≧30 | 0.34 | No Unevenness | Present Invention |
| B5 | 239 | 0 | ≧30 | 0.35 | No Unevenness | Present Invention |
| B6 | 225 | 0 | ≧30 | 0.33 | No Unevenness | Present Invention |
| B7 | 233 | 0 | ≧30 | 0.34 | No Unevenness | Present Invention |
| B8 | 205 | 0 | ≧30 | 0.36 | No Unevenness | Present Invention |
| B9 | 209 | 0 | ≧30 | 0.33 | No Unevenness | Present Invention |
| B10 | 223 | 0 | ≧30 | 0.37 | No Unevenness | Present Invention |

Note:
*Area ratio of non-fibrous or recrystallization structure (%).
**Surface roughness.

TABLE 3

| | Pre-Rolled Sheet | | Final Rolled Sheet | | Finished Sheet | | |
|---|---|---|---|---|---|---|---|
| No. | Cold Rolling (%) | Annealing Temp. (°C.) | Cold Rolling (%) | {100} Texture (%) | Annealing Temp. (°C.) | {100} Texture (%) | Change of {100} Texture |
| B11 | 95 | 950 | 80 | 96 | 730 | 97 | 1 |
| B12 | 95 | 950 | 80 | 97 | 730 | 99 | 2 |
| B13 | 95 | 950 | 80 | 96 | 730 | 97 | 1 |
| B14 | 95 | 950 | 80 | 98 | 730 | 99 | 1 |
| B15 | 95 | 950 | 80 | 97 | 730 | 99 | 2 |
| B16 | 95 | 950 | 80 | 97 | 730 | 98 | 1 |
| C1 | 95 | 950 | 80 | 97 | 730 | 99 | 2 |
| C2 | 90 | 950 | 80 | 84 | 730 | 96 | 12 |
| C3 | 95 | 800 | 80 | 79 | 730 | 91 | 12 |
| C4 | 95 | 950 | 80 | 99 | 730 | 100 | 1 |
| C5 | 90 | 950 | 80 | 81 | 730 | 90 | 9 |
| C6 | 95 | 800 | 80 | 82 | 730 | 93 | 11 |
| C7 | 95 | 950 | 80 | 80 | 730 | 92 | 12 |

| | Evaluation of Shadow Mask | | | | | |
|---|---|---|---|---|---|---|
| No. | Hardness (HV) | Non-Fibrous or Recrystallization Structure (%)* | Average Aspect Ratio | Ra of Etched Surface (μm)** | Mask Quality | Note |
| B11 | 231 | 0 | ≧30 | 0.31 | No Unevenness | Present Invention |
| B12 | 215 | 0 | ≧30 | 0.32 | No Unevenness | Present Invention |
| B13 | 225 | 0 | ≧30 | 0.35 | No Unevenness | Present Invention |
| B14 | 213 | 0 | ≧30 | 0.34 | No Unevenness | Present Invention |
| B15 | 221 | 0 | ≧30 | 0.34 | No Unevenness | Present Invention |
| B16 | 219 | 0 | ≧30 | 0.31 | No Unevenness | Present Invention |
| C1 | 179 | 0 | ≧30 | 0.34 | No Unevenness | Present Invention |
| C2 | 170 | 9 | ≧30 | 0.33 | No Unevenness | Present Invention |
| C3 | 181 | 7 | ≧30 | 0.32 | No Unevenness | Present Invention |
| C4 | 175 | 0 | ≧30 | 0.31 | No Unevenness | Present Invention |
| C5 | 188 | 11 | ≧30 | 0.35 | No Unevenness | Present Invention |
| C6 | 171 | 13 | ≧30 | 0.39 | No Unevenness | Present Invention |
| C7 | 179 | 7 | ≧30 | 0.33 | No Unevenness | Present Invention |

Note:
*Area ratio of non-fibrous or recrystallization structure (%).
**Surface roughness.

TABLE 4

| | Pre-Rolled Sheet | | Final Rolled Sheet | | Finished Sheet | | |
|---|---|---|---|---|---|---|---|
| No. | Cold Rolling (%) | Annealing Temp. (°C.) | Cold Rolling (%) | {100} Texture (%) | Annealing Temp. (°C.) | {100} Texture (%) | Change of {100} Texture |
| D1 | 95 | 950 | 80 | 90 | 730 | 91 | 1 |
| D2 | 95 | 950 | 80 | 89 | 730 | 89 | 0 |
| D3 | 95 | 950 | 80 | 91 | 730 | 92 | 1 |
| D4 | 95 | 950 | 80 | 88 | 730 | 90 | 2 |
| D5 | 95 | 950 | 80 | 88 | 730 | 89 | 1 |
| E1 | 95 | 950 | 80 | 93 | 730 | 94 | 1 |
| E2 | 95 | 950 | 80 | 95 | 730 | 97 | 2 |
| E3 | 95 | 950 | 90 | 93 | 730 | 95 | 2 |
| E4 | 95 | 950 | 80 | 91 | 730 | 92 | 1 |
| E5 | 95 | 950 | 80 | 93 | 730 | 94 | 1 |
| F1 | 75 | 950 | 80 | 38 | 730 | 82 | 44 |
| F2 | 95 | 650 | 80 | 20 | 730 | 88 | 68 |
| F3 | 95 | 950 | 98 | 44 | 730 | 98 | 54 |
| F4 | 95 | 950 | 80 | 95 | 870 | 76 | 19 |
| F5 | 75 | 650 | 98 | 21 | 730 | 83 | 62 |
| F6 | 75 | 650 | 80 | 37 | 870 | 97 | 60 |

| | Evaluation of Shadow Mask | | | | | |
|---|---|---|---|---|---|---|
| No. | Hardness (HV) | Non-Fibrous or Recrystallization Structure (%)* | Average Aspect Ratio | Ra of Etched Surface (μm)** | Mask Quality | Note |
| D1 | 179 | 0 | ≧30 | 0.39 | Slightly Uneven | Present Invention |

TABLE 4-continued

| | | | | | | |
|---|---|---|---|---|---|---|
| D2 | 177 | 0 | ≧30 | 0.37 | Slightly Uneven | Present Invention |
| D3 | 181 | 0 | ≧30 | 0.36 | Slightly Uneven | Present Invention |
| D4 | 183 | 0 | ≧30 | 0.36 | Slightly Uneven | Present Invention |
| D5 | 179 | 0 | ≧30 | 0.35 | Slightly Uneven | Present Invention |
| E1 | 229 | 0 | ≧30 | 0.36 | Slightly Uneven | Present Invention |
| E2 | 231 | 0 | ≧30 | 0.34 | Slightly Uneven | Present Invention |
| E3 | 231 | 0 | ≧30 | 0.33 | Slightly Uneven | Present Invention |
| E4 | 228 | 0 | ≧30 | 0.32 | Slightly Uneven | Present Invention |
| E5 | 229 | 0 | ≧30 | 0.33 | Slightly Uneven | Present Invention |
| F1 | 117 | 100 | 1-1.5 | 0.64 | Uneven | Com. Example*** |
| F2 | 114 | 100 | 1-1.5 | 0.63 | Uneven | Com. Example*** |
| F3 | 121 | 100 | 1-1.5 | 0.70 | Uneven | Com. Example*** |
| F4 | 129 | 100 | 1-1.5 | 0.66 | Uneven | Com. Example*** |
| F5 | 115 | 100 | 1-1.5 | 0.69 | Uneven | Com. Example*** |
| F6 | 120 | 100 | 1-1.5 | 0.75 | Uneven | Com. Example*** |

Note:
*Area ratio of non-fibrous or recrystallization structure (%).
**Surface roughness.
***Comparative Example.

In the sheets (Samples A1–E5) of the present invention, a cubic structure grew by cold rolling at a rolling reduction ratio of 85% or more and annealing at 700° C. or higher as shown in the column of "Pre-Rolled Sheet" in Tables 2–4. After the subsequent cold rolling at a rolling reduction ratio not exceeding that in the pre-rolling step and the annealing at a temperature not exceeding 850° C., the recrystallization temperature shifted to a higher temperature side, and the percentage of {100}texture became higher (88–100% after annealing) with small change. This coincides with the results shown in FIGS. 5 and 6 as mentioned below.

Because of high percentage of {100} texture and recrystallization-suppressing effect, the alloy structure of the shadow mask sheet can maintain its fibrous microstructure at a high level (area ratio of non-fibrous microstructure≦13%, average aspect ratio≧30). Also, because of the fibrous microstructure having no clear crystal grain boundaries unlike the conventional shadow mask sheets, the shadow mask sheet of the present invention can exhibit excellent etchability as verified from the data of the surface roughness Ra of etched surface (≦0.6 μm) and the mask quality in Tables 2–4. Among others, the sheets A1–C7 are best suitable for a high-resolution shadow masks due to no unevenness in a mask quality and excellent etchability because impurities were controlled sufficiently low. With respect to the sheets D1–E5, there is a little unevenness in a mask quality because impurities were not controlled sufficiently low. However, the sheets D1–E5 exhibit high etchability because of the fibrous microstructure as verified from the data of the surface roughness, and so they are still suitable for a high-resolution shadow mask.

In the column of "Finished Sheet" in Tables 2–4 the change of {100} texture indicates the change of percentage of {100} texture by the annealing at a temperature shown in the tables. It is clear from Tables 2–4 that when annealed at a temperature of 850° C. or lower, the change of percentage of {100} texture is sufficiently smaller than 30%.

On the other hand, the sheets F1–F6 of Comparative Examples which had the same compositions as those of the sheets A were subjected to cold rolling under improper conditions (F1, F5 and F6) and annealing under improper conditions (F2, F5 and F6) in the pre-rolling step, so that their cubic structures did not well grow. Also, because of the improper cold rolling conditions (F1, F3, F5 and F6) and the improper annealing conditions (F4 and F6) in the final annealing, the cubic structures were destroyed. As a result, the final shadow mask sheets had recrystallization structures or insufficiently fibrous microstructures (area ratio of non-fibrous microstructure or recrystallization structure=100%, average aspect ratio=1–1.5) like the conventional shadow mask sheets. They also had a large surface roughness Ra of 0.63–0.75 and unevenness on an etched surface.

With respect to the sheets F1–F6 of Comparative Examples, the change of percentage of {100} texture was much larger than 30% for those except for F4 and F6 which were annealed at 870° C., failing to meet the requirements of the present invention.

With respect to a pre-rolled sheet of the present invention (Sample A1) prepared by cold rolling and annealing under the conditions of 95% and 950° C. in which a cubic crystal structure was sufficiently developed, a pre-rolled sheet of Comparative Example (Sample F1) prepared by cold rolling and annealing under the conditions of 75% and 950° C., and a pre-rolled sheet of Comparative Example (Sample F2) prepared by cold rolling and annealing under the conditions of 95% and 650° C., both prerolled sheets of Comparative Examples (Samples F1 and F2) failing to have sufficiently developed cubic crystal structure, cold rolling and annealing were conducted under the conditions as shown in Tables 2 and 4.

The relation between an annealing temperature and a hardness and the relation between an annealing temperature and a percentage of {100} texture were evaluated on each sample. The results are shown in FIGS. 5 and 6.

Figure 5:
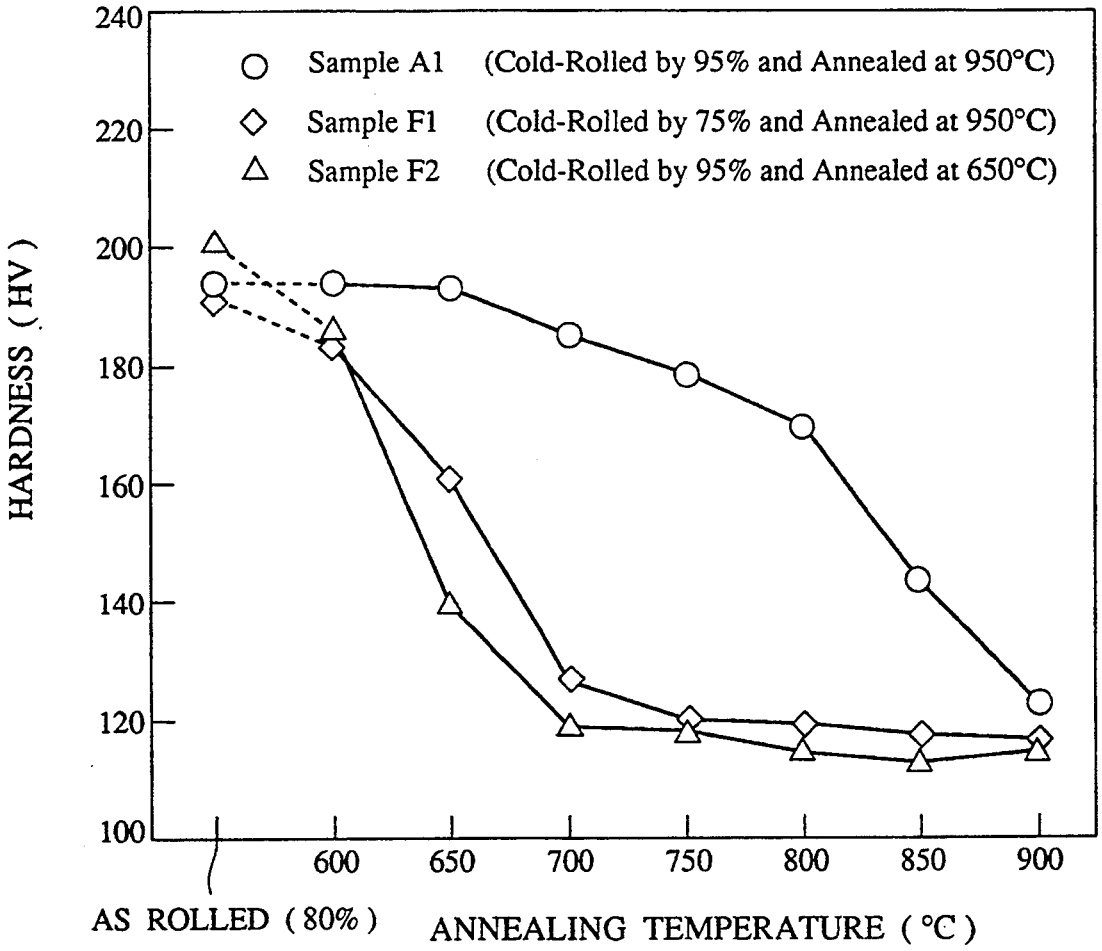
FIG. 5 is a graph showing the relation between an annealing temperature and a hardness in various shadow mask sheets.

Incidentally, in FIG. 5, "as rolled" means that measurement was conducted on a sheet which was cold-rolled at a rolling reduction ratio of 80% in the step of final rolling but not subjected to the subsequent annealing, and the annealing temperatures of 600° C. to 900° C. mean that each sample was measured after the annealing at each of the above temperatures. Also, in FIG. 6, "as annealed" means that measurement was conducted on a pre-rolled sheet which was not subjected to cold rolling in the subsequent final rolling step, and "as rolled" means that measurement was conducted on a sheet cold-rolled at a rolling reduction ratio of 80% in the step of final rolling but not subjected to the subsequent annealing. The annealing temperatures of 600° C. to 900° C. are the same as in FIG. 5.

Figure 6:
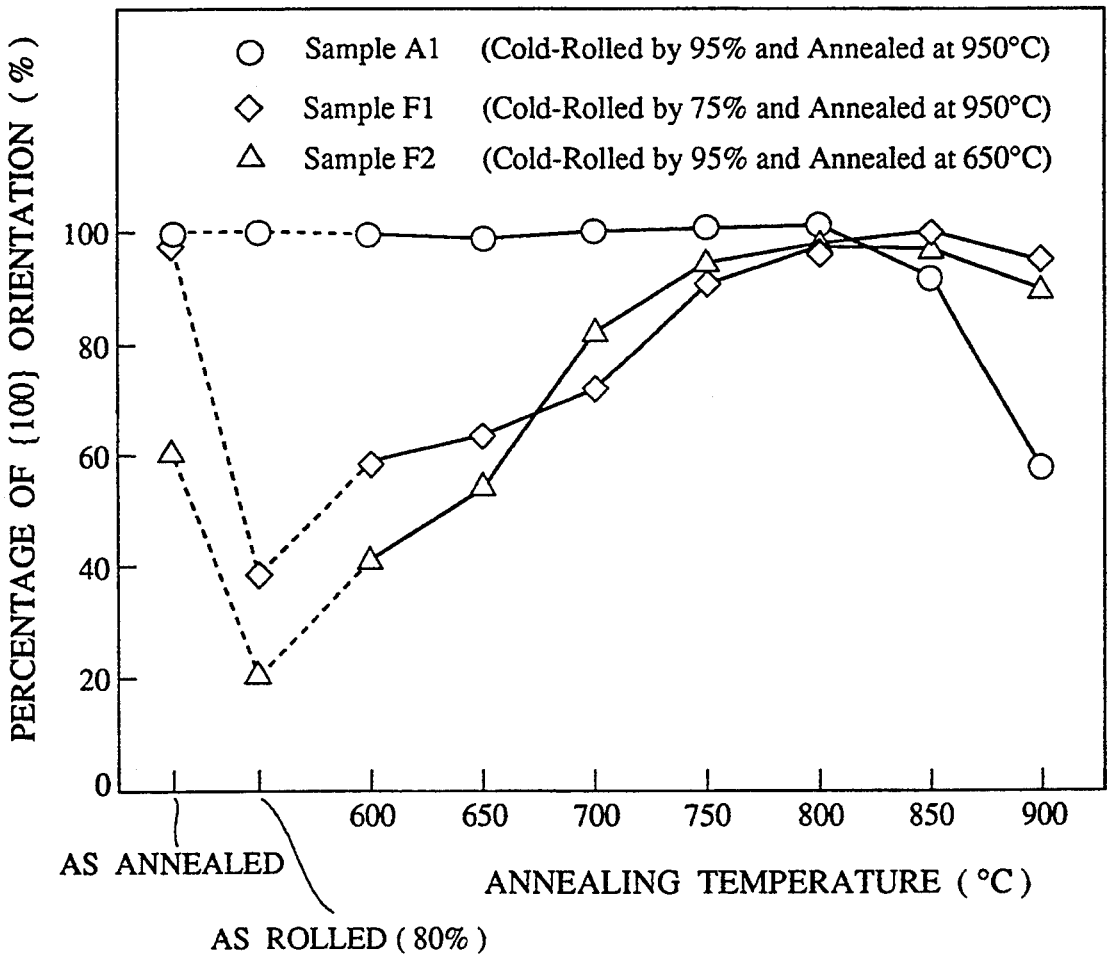
FIG. 6 is a graph showing the relation between an annealing temperature and a percentage of {100} texture in various shadow mask sheets.

FIG. 5 shows the relation between the annealing temperature and the hardness, and FIG. 6 shows the relation between the annealing temperature and the percentage of {100}texture. In a case where a pre-rolled sheet was further subjected to cold rolling as a final rolling, the resulting sheet showed an elevated recrystallization temperature, so that it showed a Vickers hardness HV of about 130 or more even when annealed at 875° C. or lower. This Vickers hardness level was extremely higher than those of Samples F1 and F2 (Comparative Examples). This fact indicates that the shadow mask sheet of the present invention is stabler than those of Comparative Examples in an alloy structure.

FIG. 6 shows that when the pre-rolled sheet satisfying the requirements of the present invention was cold-rolled in the final rolling step, the resulting final rolled sheet showed little change (about 10% or less) in the percentage of {100} texture even after annealing at a temperature up to 850° C. FIG. 6 further shows that even when the final rolled sheet was annealed at a temperature of 875° C., the change of percentage of {100} texture was only about 25% or less.

Accordingly, it is clear that the pre-rolled sheet prepared according to the method of the present invention is little affected by cold rolling and annealing in the subsequent finish-rolling step with respect to the change of percentage of {100} texture.

As is clear from FIG. 5, the shadow mask sheets of the present invention are sufficiently hard, so that they are easy to handle and that they can be made sufficiently thin as shadow masks, which makes it easier to conduct etching.

As shown in FIG. 6, the finish-rolled sheets of Samples F1 and F2 (Comparative Examples) having a percentage of {100} texture which decreased to less than 85% by cold rolling should be annealed at a temperature of about 750° C. or higher in order to recover 85% or more of percentage of {100} texture. However, in the case of the final rolled sheets of Samples F1 and F2, the annealing at such a high temperature decreases the Vickers hardness HV to less than 130, an insufficient level.

In the final rolled sheet for a shadow mask of the present invention, its percentage of {100} texture changes only 30% or less by the annealing thereby being able to suppress the recrystallization. Since the percentage of {100} texture of 85% or more can be obtained by the annealing at a temperature of 850° C. or lower on the final rolled sheet for a shadow mask of the present invention as shown in FIG. 6, this annealing temperature of 850° C. or lower is critical.

As described above in detail, since the shadow mask sheet of the present invention has a fibrous microstructure which is completely different from the non-fibrous microstructure or recrystallization structure of the conventional shadow mask sheets, the shadow mask sheet of the present invention shows excellent etchability with extremely small surface roughness and shape irregularity of etched pores. The resulting shadow mask does not substantially have unevenness.

The method of the present invention can produce the shadow mask having good evenness without necessitating the complicated control of cold rolling and annealing conditions to optimize the alloy structure unlike the conventional methods.

Therefore, the present invention provides the shadow mask suitable for cathode ray tubes of TVs and displays having increasingly higher resolution.

What is claimed is:

1. A shadow mask sheet having excellent etchability and made of an Fe-Ni invar alloy consisting essentially of 30–40 weight of Ni, the balance being substantially Fe and inevitable impurities, said sheet having a percentage of {100} texture of 85% or more in a rolled surface, and having a fibrous microstructure in a transverse cross section of said sheet.

2. The shadow mask sheet having excellent etchability according to claim 1, wherein among said inevitable impurities, C is 0.005 weight % or less, S is 0.005 weight % or less, P is 0.005 weight or less, 0 is 0.005 weight % or less, and N is 0.005 weight % or less.

3. The shadow mask sheet having excellent etchability according to claim 1, wherein an area ratio of a non-fibrous microstructure in a transverse cross section of said sheet is less than 50%.

4. The shadow mask sheet having excellent etchability according to claim 1, wherein a surface of said sheet spray-etched with an $FeCl_3$ solution (42 Baumé, 60° C.) has a surface roughness Ra of 0.6 μm or less in the transverse direction of said sheet.

5. The shadow mask sheet having excellent etchability according to claim 1, wherein said sheet has crystal grains having an average aspect ratio of 3 or more in a transverse cross section of said sheet, and has a Vickers hardness HV of 130 or more.

6. A final rolled sheet for a shadow mask sheet having excellent etchability, wherein said final rolled sheet is produced from a pre-rolled sheet having a cubic structure and made of an Fe-Ni invar alloy recited in claim 1, the percentage of {100} texture being changed by 30% or less by annealing at 850° C. or lower to produce said shadow mask sheet.

7. A method of producing a shadow mask sheet having excellent etchability, comprising the steps of hot-rolling an Fe-Ni invar alloy having a composition recited in claim 1; conducting cold rolling at a rolling reduction ratio of 85% or more and annealing at 700° C. or higher in this order at least once; and then conducting cold rolling at a rolling reduction ratio not exceeding that in the previous cold rolling step and annealing at a temperature of 850° C. or lower in this order.

8. A cathode ray tube provided with a shadow mask prepared from said shadow mask sheet recited in claim 1 by etching.

9. A shadow mask sheet having excellent etchability and made of an Fe-Ni invar alloy consisting essentially of 30–40 weight of Ni, 0.001–3 weight % in totality of at least one element selected from the group consisting of Nb, Ti, Zr, Mo, V, W, Be, Si, Al and Ta, the balance being substantially Fe and inevitable impurities, said sheet having a percentage of {100} texture of 85% or more in a rolled surface, and having a fibrous microstructure in a transverse cross section of said sheet.

10. The shadow mask sheet having excellent etchability according to claim 9, wherein among said inevitable impurities, C is 0.005 weight % or less, S is 0.005 weight % or less, P is 0.005 weight or less, 0 is 0.005 weight % or less, and N is 0.005 weight % or less.

11. The shadow mask sheet having excellent etchability according to claim 9, wherein an area ratio of a non-fibrous microstructure in a transverse cross section of said sheet is less than 50%.

12. The shadow mask sheet having excellent etchability according to claim 9, wherein a surface of said sheet spray-etched with an $FeCl_3$ solution (42 Baumé, 60° C.) has a surface roughness Ra of 0.6 μm or less in the transverse direction of said sheet.

13. The shadow mask sheet having excellent etchability according to claim 9, wherein said sheet has crystal grains having an average aspect ratio of 3 or more in a transverse cross section of said sheet, and has a Vickers hardness HV of 130 or more.

14. A final rolled sheet for a shadow mask sheet having excellent etchability, wherein said final rolled sheet is produced from a pre-rolled sheet having a cubic structure and made of an Fe-Ni invar alloy recited in claim 9, the percentage of {100} texture being changed by 30% or less by annealing at 850° C. or lower to produce said shadow mask sheet.

15. A method of producing a shadow mask sheet having excellent etchability, comprising the steps of hot-rolling an Fe-Ni invar alloy having a composition recited in claim 9; conducting cold rolling at a rolling reduction ratio of 85% or more and annealing at 700° C. or higher in this order at least once; and then conducting cold rolling at a rolling reduction ratio not exceeding that in the previous cold rolling step and annealing at a temperature of 850° C. or lower in this order.

16. A cathode ray tube provided with a shadow mask prepared from said shadow mask sheet recited in claim 9 by etching.

17. A shadow mask sheet having excellent etchability and made of an Fe-Ni invar alloy consisting essentially of 30–40 weight % of Ni, the balance being substantially Fe and inevitable impurities, a part of Ni being substituted with 10 weight % or less of Co and/or 5 weight % or less of Cr, said sheet having a percentage of {100} texture of 85% or more in a rolled surface, and having a fibrous microstructure in a transverse cross section of said sheet.

18. The shadow mask sheet having excellent etchability according to claim 17, wherein among said inevitable impurities, C is 0.005 weight % or less, S is 0.005 weight % or less, P is 0.005 weight or less, 0 is 0.005 weight % or less, and N is 0.005 weight % or less.

19. The shadow mask sheet having excellent etchability according to claim 17, wherein an area ratio of a non-fibrous microstructure in a transverse-cross section of said sheet is less than 50%.

20. The shadow mask sheet having excellent etchability according to claim 17, wherein a surface of said sheet spray-etched with an $FeCl_3$ solution (42 Baumé, 60° C.) has a surface roughness Ra of 0.6 μm or less in the transverse direction of said sheet.

21. The shadow mask sheet having excellent etchability according to claim 17, wherein said sheet has crystal grains having an average aspect ratio of 3 or more in a transverse cross section of said sheet, and has a Vickers hardness HV of 130 or more.

22. A final rolled sheet for a shadow mask sheet having excellent etchability, wherein said final rolled sheet is produced from a pre-rolled sheet having a cubic structure and made of an Fe-Ni invar alloy recited in claim 17, the percentage of {100} texture being changed by 30% or less by annealing at 850° C. or lower to produce said shadow mask sheet.

23. A method of producing a shadow mask sheet having excellent etchability, comprising the steps of hot-rolling an Fe-Ni invar alloy having a composition recited in claim 17; conducting cold rolling at a rolling reduction ratio of 85% or more and annealing at 700° C. or higher in this order at least once; and then conducting cold rolling at a rolling reduction ratio not exceeding that in the previous cold rolling step and annealing at a temperature of 850° C. or lower in this order.

24. A cathode ray tube provided with a shadow mask prepared from said shadow mask sheet recited in claim 17 by etching.

25. A shadow mask sheet having excellent etchability and made of an Fe-Ni invar alloy consisting essentially of 30–40 weight of Ni and 0.0001–0.001 weight % in totality of at least one element selected from the group consisting of B, Mg and Ca, the balance being substantially Fe and inevitable impurities, said sheet having a percentage of {100} texture of 85% or more in a rolled surface, and having a fibrous microstructure in a transverse cross section of said sheet.

26. The shadow mask sheet having excellent etchability according to claim 25, wherein among said inevitable impurities, C is 0.005 weight % or less, S is 0.005 weight % or less, P is 0.005 weight or less, 0 is 0.005 weight % or less, and N is 0.005 weight % or less.

27. The shadow mask sheet having excellent etchability according to claim 25, wherein an area ratio of a non-fibrous microstructure in a transverse cross section of said sheet is less than 50%.

28. The shadow mask sheet having excellent etchability according to claim 25, wherein a surface of said sheet spray-etched with an $FeCl_3$ solution (42 Baumé, 60° C.) has a surface roughness Ra of 0.6 μm or less in the transverse direction of said sheet.

29. The shadow mask sheet having excellent etchability according to claim 25, wherein said sheet has crystal grains having an average aspect ratio of 3 or more in a transverse cross section of said sheet, and has a Vickers hardness HV of 130 or more.

30. A final rolled sheet for a shadow mask sheet having excellent etchability, wherein said final rolled sheet is produced from a pre-rolled sheet having a cubic structure and made of an Fe-Ni invar alloy recited in claim 25, the percentage of {100} texture being changed by 30% or less by annealing at 850° C. or lower to produce said shadow mask sheet.

31. A method of producing a shadow mask sheet having excellent etchability, comprising the steps of hot-rolling an Fe-Ni invar alloy having a composition recited in claim 25; conducting cold rolling at a rolling reduction ratio of 85% or more and annealing at 700° C. or higher in this order at least once; and then conducting cold rolling at a rolling reduction ratio not exceeding that in the previous cold rolling step and annealing at a temperature of 850° C. or lower in this order.

32. A cathode ray tube provided with a shadow mask prepared from said shadow mask sheet recited in claim 25 by etching.

33. A shadow mask sheet having excellent etchability and made of an Fe-Ni invar alloy consisting essentially of 30–40 weight of Ni, and 0.001–3 weight % in totality of at least one element selected from the group consisting of Nb, Ti, Zr, Mo, V, W, Be, Si, Al and Ta, the balance being substantially Fe and inevitable impurities, a part of Ni being substituted with 10 weight % or less of Co and/or 5 weight % or less of Cr, said sheet having a percentage of {100} texture of 85% or more in a rolled surface, and having a fibrous microstructure in a transverse cross section of said sheet.

34. The shadow mask sheet having excellent etchability according to claim 33, wherein among said inevitable impurities, C is 0.005 weight % or less, S is 0,005 weight % or less, P is 0.005 weight or less, 0 is 0.005 weight % or less, and N is 0.005 weight % or less.

35. A shadow mask sheet having excellent etchability and made of an Fe-Ni invar alloy consisting essentially of 30–40 weight of Ni, 0.001–3 weight % in totality of at least one element selected from the group consisting of Nb, Ti, Zr, Mo, V, W, Be, Si, Al and Ta, and 0.0001–0.001 weight % in totality of at least one element selected from the group consisting of B, Mg and Ca, the balance being substantially Fe and inevitable impurities, said sheet having a percentage of {100} texture of 85% or more in a rolled surface, and having a fibrous microstructure in a transverse cross section of said sheet.

36. The shadow mask sheet having excellent etchability according to claim 35, wherein among said inevitable impurities, C is 0.005 weight % or less, S is 0.005 weight % or less, P is 0.005 weight % or less, 0 is 0.005 weight % or less, and N is 0.005 weight or less.

37. A shadow mask sheet having excellent etchability and made of an Fe-Ni invar alloy consisting essentially of 30–40 weight of Ni, and 0.0001–0.001 weight % in totality of at least one element selected from the group consisting of B, Mg and Ca, the balance being substantially Fe and inevitable impurities, a part of Ni being substituted with 10 weight % ,or less of Co and/or 5 weight % or less of Cr, said sheet having a percentage of {100} texture of 85% or more in a rolled surface, and having a fibrous microstructure in a transverse cross section of said sheet.

38. The shadow mask sheet having excellent etchability according to claim 37, wherein among said inevitable impurities, C is 0.005 weight % or less, S is 0.005 weight % or less, P is 0.005 weight % or less, 0 is 0.005 weight % or less, and N is 0.005 weight or less.

39. A shadow mask sheet having excellent etchability and made of an Fe-Ni invar alloy consisting essentially of 30–40 weight of Ni, 0.001–3 weight % in totality of at least one element selected from the group consisting of Nb, Ti, Zr, Mo, V, W, Be, Si, Al and Ta, and 0.0001–0.001 weight % in totality of at least one element selected from the group consisting of B, Mg and Ca, the balance being substantially Fe and inevitable impurities, a part of Ni being substituted with 10 weight % or less of Co and/or 5 weight % or less of Cr, said sheet having a percentage of {100} texture of 85% or more in a rolled surface, and having a fibrous microstructure in a transverse cross section of said sheet.

40. The shadow mask sheet having excellent etchability according to claim 39, wherein among said inevitable impurities, C is 0.005 weight % or less, S is 0.005 weight % or less, P is 0.005 weight % or less, 0 is 0.005 weight % or less, and N is 0.005 weight or less.

* * * * *